United States Patent [19]

Knight

[11] 4,160,496

[45] Jul. 10, 1979

[54] FOLDABLE HAND BAGGAGE

[76] Inventor: Kenneth R. Knight, 11 Kendal Close, Reigate, Surrey, England

[21] Appl. No.: 795,634

[22] Filed: May 10, 1977

[51] Int. Cl.[2] ..... A45C 7/00; A45C 13/00

[52] U.S. Cl. ..... 190/43; 190/41 Z

[58] Field of Search ..... 190/41 Z, 43, 53, 49, 190/50

[56] References Cited

U.S. PATENT DOCUMENTS

| | | | |
|---|---|---|---|
| 2,425,035 | 8/1947 | Garnett et al. | 190/41 Z |
| 2,555,718 | 6/1951 | Vineberg | 190/43 |
| 2,717,620 | 9/1955 | Renz | 190/41 Z |
| 2,718,943 | 9/1955 | Braverman | 190/43 |
| 3,730,308 | 5/1973 | Pelavin | 190/41 Z |

FOREIGN PATENT DOCUMENTS

| | | | |
|---|---|---|---|
| 462474 | 1/1950 | Canada | 190/43 |
| 554062 | 3/1958 | Canada | 190/53 |
| 1174502 | 3/1959 | France | 190/43 |
| 1191799 | 4/1959 | France | 190/43 |
| 580953 | 9/1946 | United Kingdom | 190/43 |

*Primary Examiner*—Joseph Man-Fu Moy
*Attorney, Agent, or Firm*—Browdy and Neimark

[57] ABSTRACT

A foldable item of hand baggage comprises a body portion and a lid comprising a top portion and a side wall region, zip fastener means being provided at the free edge of the side wall portion and an adjacent part of the body portion for closing the hand baggage. Two types of reinforcement for imparting rigidity to the assembled hand baggage are provided. Inner rigid elements are provided in each of the lateral walls, being held to the rest of the body portion in a manner allowing them to be moved towards one of the front and rear walls when the item of hand baggage is to be folded. Moreover, disposed between the inner rigid element and the body portion are intermediate members which are rigid in the depthwise direction of the item of hand baggage over their entire height which is equal to the height of the item of hand baggage when closed and are flexible in the lengthwise direction thereof so as to provide radius corner sections matched to rounded corner sections at which adjacent walls of the body portion are interconnected.

6 Claims, 13 Drawing Figures

FOLDABLE HAND BAGGAGE

This invention relates to foldable hand-baggage of the type with a zip-fastening top or lid.

The construction of foldable suitcases and other types of hand baggage with zip-fastening tops has hitherto been such that considerable strain is placed on the zip fastener at the corners of the hand baggage. This has, in some instances, resulted in the zip-fastener tearing away from the rest of the baggage at the corners.

The present invention aims to provide foldable hand baggage of the type with a zip-fastening top or lid in which the strain on the zip fastener at the corners of the hand baggage is reduced.

According to the present invention, there is provided a foldable item of hand baggage, of the type with a zip-fastening lid, which comprises a body portion having a base and four walls and a hand grip attached to the front wall of the body portion, the rear edge of the lid being attached to the rear wall of the body portion, and the remaining edges of the lid, and corresponding edges of the walls of the body portion, being provided with a zip-fastener, wherein (a) each wall of the body portion includes an inner rigid element, the inner rigid element in each of the lateral walls being held to the rest of the body portion in a manner permitting it to be moved towards one of the front and rear walls when the item of handbaggage is to be folded; (b) the base of the body portion and the outer covering of the four walls of the body portion are formed of a material which is flexible so as to facilitate folding; and (c) the walls of the body portion contain at least two intermediate members located between the inner rigid elements and the outer covering which intermediate members are continuous in the region of, and extend around, the corners between adjacent walls of the body portion to constitute a radius corner at each corner of the body portion, said members being foldable at the radius corners towards one of the front and rear walls when the lateral inner rigid elements have been moved towards one of the front and rear walls.

In preferred embodiments, the lid of the suitcase or other item comprises a top portion and sidewall portions extending therefrom, and the intermediate members are greater in height than the other parts of the walls of the body portion, the arrangement being such that, when the lid of the suitcase or other item of hand baggage is zip-fastened to the body portion thereof, all or a substantial part of the upper edges of said intermediate members extends beyond the upper edges of the inner rigid elements of the walls of the body portion into the lid.

The invention will be described hereinafter by reference to a suitcase, though the invention is applicable to other forms of hand baggage.

Generally, the walls of the body portion of a suitcase of this invention consist of three layers. The outermost layer will be a soft finishing layer, such as a natural or synthetic fabric or leather, an intermediate layer constituted by said at least two intermediate members, and an inner layer constituted by the inner rigid elements, formed, for example, from plywood coated with a suitable finishing material, for example a synthetic plastics material, e.g., P.V.C. sheet.

The intermediate members must be formed of a material which is sufficiently rigid to provide the necessary support for the zip fastener at the corners of the case, while being resilient enough to be hinged about the radius corners without cracking or breaking. A material suitable for this use is low density polythene or a reinforced synthetic resin, for example a filled or laminated resin, for example filled polyvinyl chloride.

The material may be formed into strips 1 mm thick, two such strips being adhesively connected in order to constitute the central members.

Advantageously, there are two or three intermediate members; with two, each is in the form of an elongated, squarish "C" and the members are disposed so that the major wall of one of the intermediate members lies along the front wall of the body portion of the suitcase, while the major wall of the other intermediate member lies along the rear wall. The lateral walls of the suitcase include a minor wall of each of the two intermediate members. With three intermediate members, there is a single "square-C" member at the front of the case and two "L" members around the rear corners of the case.

The intermediate members may extend upwardly beyond the level of the inner rigid elements over their entire length; alternatively, the regions of the intermediate members at the radius corners may be cut down to the level of the inner rigid elements.

For a better understanding of the invention, and to show how the same may be carried into effect, reference will now be made, by way of example, to the accompanying drawings, which illustrate one embodiment of a suitcase in accordance with the invention, and in which.

Figure 1:
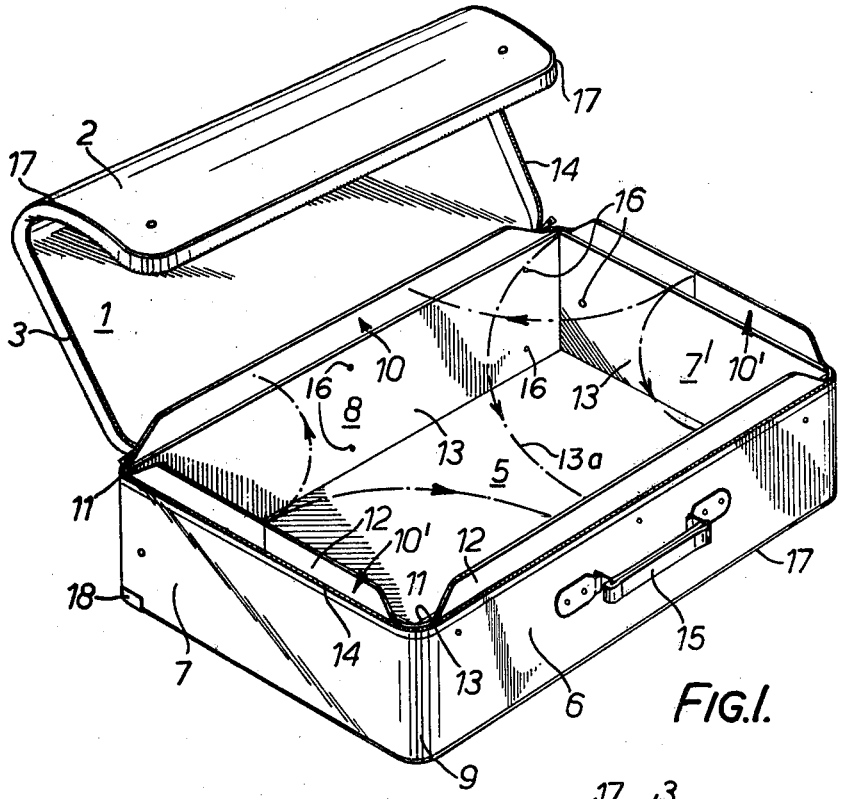
FIG. 1 is an isometric view of the suitcase.

Referring to the drawings, the suitcase comprises a lid 1 having a top portion 2 and a continuous sidewall portion 3 secured thereto. Piping 17 extends around the edge between the top portion 2 and the sidewall portion 3 of the lid. The body 4 of the suitcase is constituted by a base portion 5, a front wall 6, lateral walls 7 and 7', and a rear wall 8. A handle 15 is secured to the front wall 6. Each wall of the body portion of the suitcase comprises three layers. Outermost is a fabric covering 9, continuous around the four body walls. The inner surface of the outer fabric covering 9 contacts two identically shaped intermediate members 10 and 10' each of which has two radius corners 11. The innermost layer of each of the walls of the body portion consists of an inner rigid element 13 attached to the intermediate member 10 or 10' behind it by means of press-studs 16. Six press-studs (see FIG. 1 in which four press-studs can be seen) hold the front and rear elements 13 to the intermediate members therebehind while the lateral rigid elements 13 are attached by two studs 16 to the adjacent intermediate members. As can be seen from FIG. 6, the inner rigid elements of the lateral walls fold towards the front wall 6 of the suitcase during a folding operation. Portions 12 of the intermediate members 10 and 10' extend above the uppermost edges of the outer fabric covering 9 and of the inner rigid elements 13. A zip fastener 14 connects the lateral walls and front wall of the body portion of the suitcase with corresponding sidewall portions of the lid 1. The rear wall 8 of the body portion of the suitcase is firmly attached to the corresponding portion of the lid 1 by webbing 19 through which feet 20 are attached to the suitcase (see FIG. 2C). Piping 17 is provided around the base 5 of the body portion of the suitcase, and brackets 18 may be provided in order to offer protection against scuffing.

Figure 5:
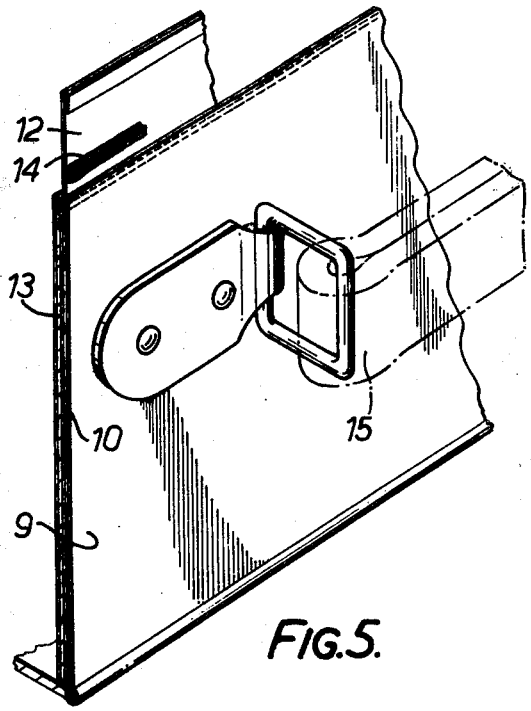
FIG. 5 is a view showing in detail part of the front wall of the suitcase.

The inner rigid elements 13 may be formed, in this embodiment, from 4 mm plywood which is covered on both surfaces with sheets made from polyvinyl chloride. The intermediate members 10 and 10' each consist of two strips adhesively secured together face to face, each strip consisting of a heavy gauge, low density polyethylene. Each of the strips is advantageously 1 mm in thickness. The handle 15 is formed in a conventional manner, and is secured to the front wall 6 of the body portion of the suitcase as shown in FIG. 5.

Figure 6:
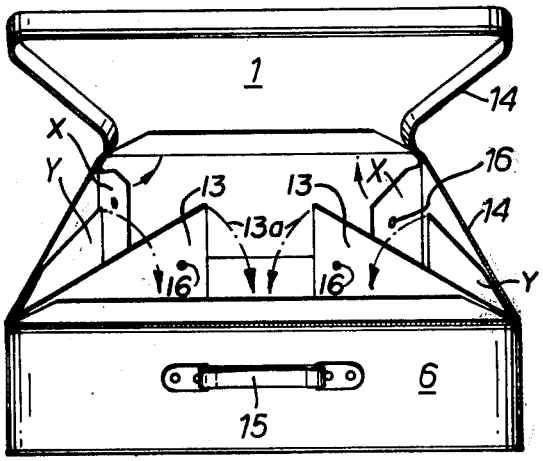
FIGS. 6, 7, 8 and 9 show successive stages in the folding of the suitcase.
Figure 7:
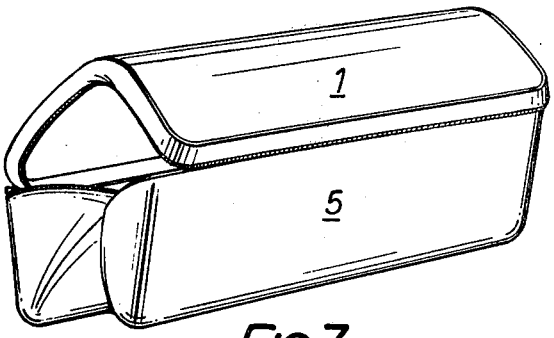
Figure 8:
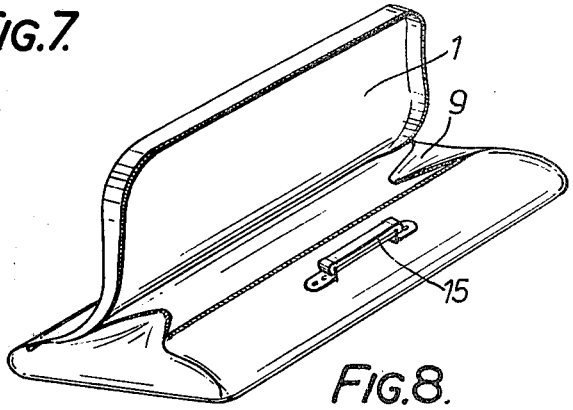
Figure 9:
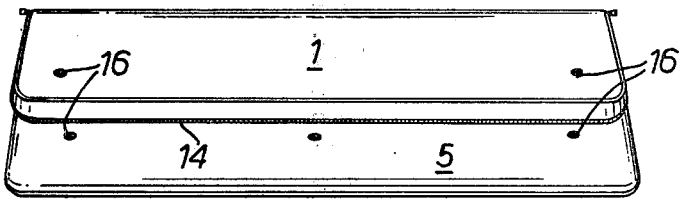
Figure 10:
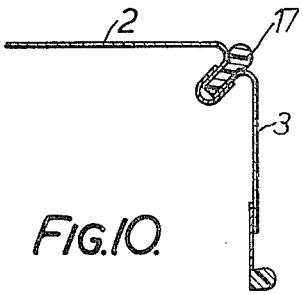
FIG. 10 is a sectional view of the lid of the suitcase.

The suitcase shown in the drawing may be folded as shown in FIGS. 1 and 6 to 9. With the lid 1 in the open position, press-studs 16 (see FIG. 1) are unfastened thereby releasing the rigid elements 13 of the body portion from the adjacent intermediate members. The rigid elements are swung towards the front wall 6 along the path 13*a* as shown in FIG. 6. Thereafter, the minor sides of the intermediate members 10 and 10' are pivoted about their radius corners so that the minor sides of intermediate member 10' move towards front wall 6, while the minor sides of intermediate member 10 move towards rear wall 8 of the suitcase. In this stage, the lateral walls of the suitcase are reduced to the flexible outer fabric covering 9, so that they may be pushed inwards while the base portion 5 of the suitcase is folded about a central line extending from one lateral wall 7 to the other lateral wall 7'. Thereafter, the front wall 6(together with the rigid elements 13 lying thereagainst and the minor sides of intermediate members 10' folded parts marked Y in FIG. 6) is laid flat, as is the rear wall 8 (together with the minor sides of intermediate member 10 marked X in FIG. 6). The arrangement at this stage is indicated in FIG. 8. Thereafter, the front portion of the lid is brought down over the handle 15 whereby further press-studs 16 cooperate in order to hold the suitcase in the fully folded position. FIG. 9 shows these press-studs 16 about to be fastened together.

Figure 2A:
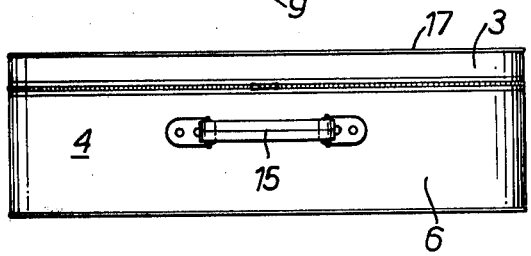
FIGS. 2A, 2B and 2C are elevational views of the suitcase with the lid closed.
Figure 2B:
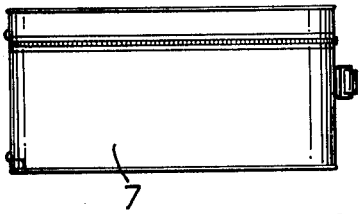
Figure 2C:
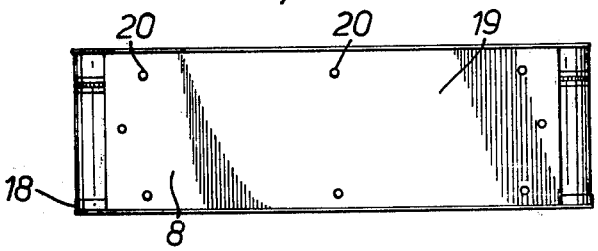
Figure 3:
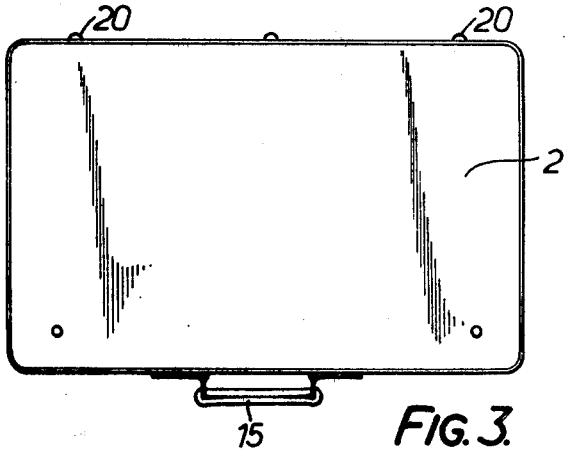
FIG. 3 is a plan view of the suitcase with the lid closed.
Figure 4A:
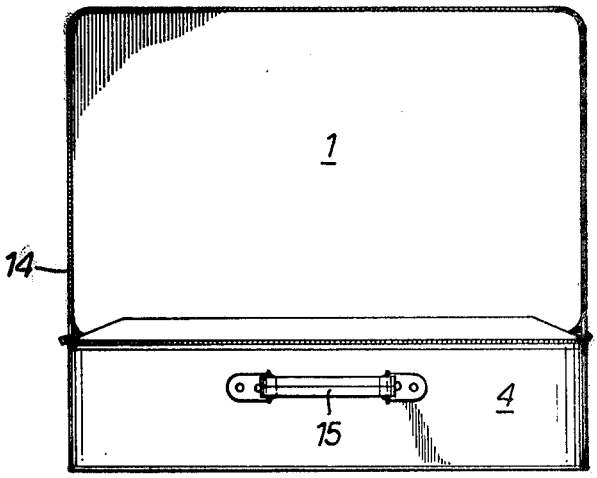
FIGS. 4A and 4B are elevational views of the suitcase with the lid open.
Figure 4B:
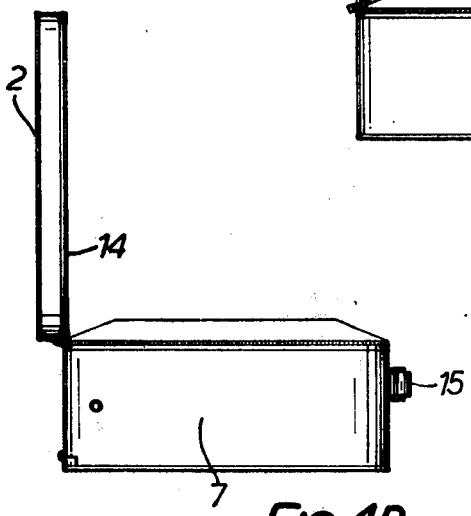

As can be seen from FIG. 1, the portions 12 of each of the intermediate members 10 and 10' extend upwardly of the remainder of the walls of the body portion over the entire upper edges of the intermediate members except in the vicinity of the radius corners. The portions 12 of the intermediate members fit against the side wall portion 3 of the lid when the lid is secured to the body portion of the suitcase by the zip fastener 14. In this closed position, the intermediate members 10 and 10' give added strength especially to the upper part of the suitcase in the region of the zip-fastener 14, and also provide support for the lid 1. In the embodiment illustrated, the intermediate members are cut out at the radius corners in order to facilitate opening and closing of the suitcase. This arrangement is believed to be particularly beneficial with large suitcases, but is not necessary with smaller items of hand baggage.

I claim:

1. A foldable item of hand baggage which comprises a body portion and rear, front and a pair of lateral walls, adjacent walls being interconnected through rounded corner sections forming an outer covering, and a hand grip attached to the front wall of the body portion, and a lid comprising a top portion which lies parallel to said base when the item of hand baggage is in its unfolded state and closed and a side wall region at right angles thereto extending around the periphery of the top portion and providing rear, front and a pair of lateral free edges adjacent the body portion, the sidewall region extending in alignment with said walls and rounded corner sections of the body portion, the lid being attached to the rear wall of the body portion at the rear free edge of its side wall region, and the remaining free edges of its side wall region of the lid, and corresponding edges of the walls of the body portion being provided with a zip-fastener, wherein (a) each wall of the body portion includes an inner rigid element, the inner rigid element in each of the lateral walls being held to the rest of the body portion in a manner permitting it to be moved towards one of the front and rear walls when the item of hand baggage is to be folded; (b) the base of the body portion and said four walls of the body portion are formed of a material which is flexible so as to facilitate folding; and (c) at least two intermediate members are located between the inner rigid elements and the outer covering, which intermediate members are rigid in the depthwise direction of the item of hand baggage over their entire height, are continuous in the region of, and extend around, the corner sections between adjacent walls of the body portion to constitute a radius corner at each corner of the body portion, and have a height greater than the depth of the body portion over at least a substantial portion of their length, said members being foldable at the radius corners towards one of the front and rear walls of said body portion when the lateral rigid elements have been moved towards one of the front and rear walls, and the arrangement being such that, when the lid of the item of hand baggage is zip-fastened to the body portion thereof, a substantial part of the upper edges of said intermediate members extends beyond the upper portion of the inner rigid elements associated with the walls of the body portion into the lid.

2. An item of hand baggage as claimed in claim 1, wherein said intermediate members are formed of a reinforced synthetic resin.

3. An item of hand baggage as claimed in claim 2, wherein said resin is polyvinyl chloride.

4. An item of hand baggage as claimed in claim 1, wherein the intermediate members are formed of a low density polyolefin.

5. An item of hand baggage as claimed in claim 1, wherein there are two intermediate members each comprising a major portion which is located respectively in the front or rear wall of the body portion of the item of hand baggage, and two minor portions which, in the unfolded condition, form part of the lateral walls of the body portion.

6. An item of hand baggage as claimed in claim 1, wherein said intermediate members extend beyond the upper edge of the inner rigid elements as all portions thereof except in the vicinity of the radius corners.

* * * * *